United States Patent [19]

Tratz et al.

[11] 4,057,103

[45] Nov. 8, 1977

[54] FEEDWATER PREHEATER WITH TWO STEAM CHAMBERS

[75] Inventors: Herbert Tratz, Ottensoos; Fritz Kelp; Erich Netsch, both of Erlangen, all of Germany

[73] Assignee: Kraftwerk Union Aktiengesellschaft, Mulheim (Ruhr), Germany

[21] Appl. No.: 638,458

[22] Filed: Dec. 8, 1975

[30] Foreign Application Priority Data

Dec. 10, 1974 Germany ..... 2458474

[51] Int. Cl.[2] ..... F22D 1/32

[52] U.S. Cl. ..... 165/11; 122/32; 165/110; 165/158

[58] Field of Search ..... 122/32; 165/11, 110, 165/158

[56] References Cited

U.S. PATENT DOCUMENTS 3,101,595 8/1963 Peters ..... 165/110 X

*Primary Examiner*—Alan Cohan
*Assistant Examiner*—Gerald A. Michalsky
*Attorney, Agent, or Firm*—Herbert L. Lerner

[57] ABSTRACT

Feedwater preheater installable horizontally within a turbine exhaust steam housing for heating feedwater by means of condensing bleeder steam from the turbine, includes inlet and outlet chambers for the feedwater both located at one side of the preheater, an outer steam chamber adjacent the inlet and outlet chambers, an inner steam chamber disposed within the outer steam chamber, means for supplying the bleeder steam at different pressures to the respective steam chambers, a water chamber closed in itself partially defining the inner steam chamber, a plurality of feedwater conducting tubes communicating with the feedwater inlet chamber and disposed in the outer steam chamber, the tubes having a substantially 180° bend formed therein at a location of the outer steam chamber remote from the feedwater inlet chamber and communicating at the bend thereof with the water chamber, and a plurality of additional tubes disposed in the inner steam chamber and communicating at one end thereof with said water chamber and at the other end thereof with said outlet chamber.

3 Claims, 1 Drawing Figure

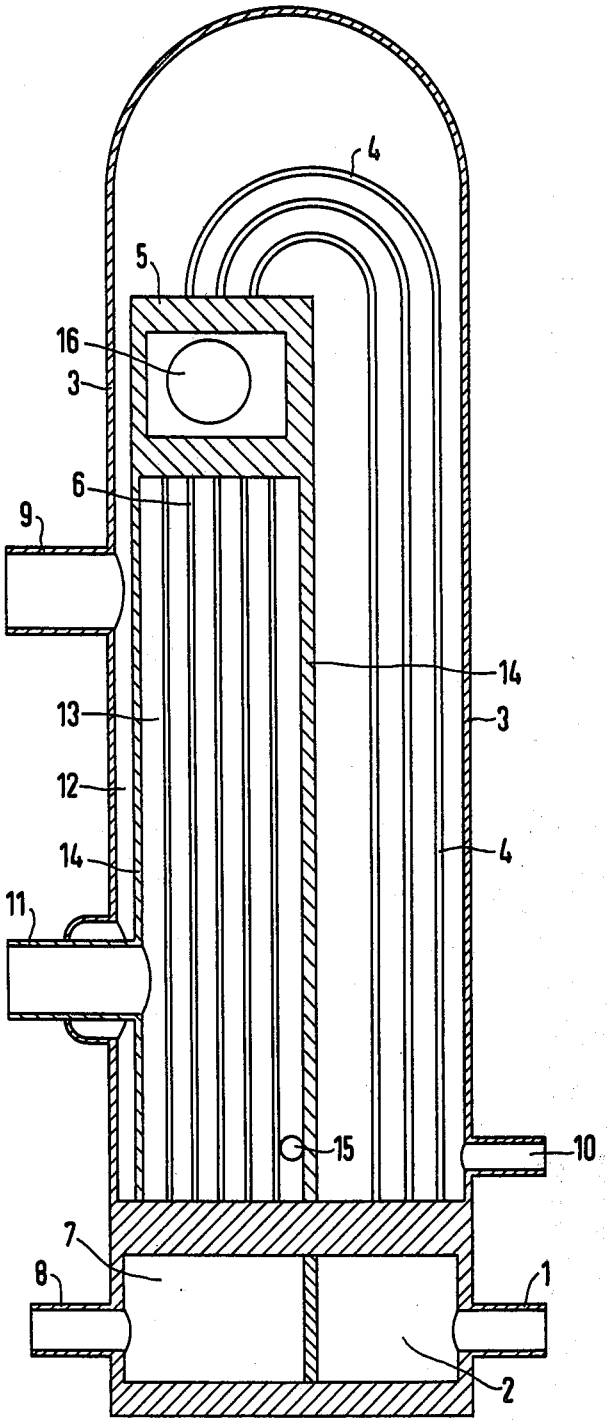
4
5
16
3
6
9
14
13
3
12
4
14
11
15
10
7
8
1
2

FEEDWATER PREHEATER WITH TWO STEAM CHAMBERS

The invention of the instant application relates to a feedwater preheater for two-stage heating of steam turbine condensate by means of condensing turbine bleeder steam. The feedwater preheater is horizontally disposed in the interior of the exhaust steam housing of a turbine. Such a feedwater preheater has become known heretofore from German Pat. No. 1,626,210 wherein tubes bent into hair-pin shape are secured in a tube plate so that each tube and each tube system can perform the expansion movements that are necessary to avoid thermal stresses. The preheater is thus traversed in four channels by the feedwater.

It has become apparent that, in turbosets of high capacity, especially for light water-nuclear power plants, the space available in vertical direction is insufficient for receiving therein a preheater with four feedwater channels. An increase in the size of the structure is very costly, and a decrease in the diameter of the feedwater-preheater with four flow-through channels results in excessive feedwater velocities.

It is accordingly an object of the invention to provide a preheater constructed with only two flow-through channels for the feedwater so that steam with two different pressures is utilized for heating the feedwater and so that the preheater can be installed in the exhaust steam connecting piece of a turbine without increasing the overall height or headroom.

With the foregoing and other objects in view, there is provided, in accordance with the invention, a feedwater preheater installable horizontally within a turbine exhaust steam housing for heating feedwater by means of condensing bleeder steam from the turbine, comprising inlet and outlet chambers for the feedwater both located at one side of the preheater, an outer steam chamber adjacent the inlet and outlet chambers, an inner steam chamber disposed within the outer steam chamber, means for supplying the bleeder steam at different pressures to the respective steam chambers, a water chamber closed in itself partially defining the inner steam chamber, a plurality of feedwater conducting tubes communicating with the feedwater inlet chamber and disposed in the outer steam chamber, the tubes having a substantially 180° bend formed therein at a location of the outer steam chamber remote from the feedwater inlet chamber and communicating at the bend thereof with the water chamber, and a plurality of additional tubes disposed in the inner steam chamber and communicating at one end thereof with the water chamber and at the other end thereof with the outlet chamber.

In accordance with another feature of the invention, the number of the plurality of tubes in the outer steam chamber differs from the number in the inner steam chamber yet has an inner cross section substantially equal to that of the plurality of tubes in the inner steam chamber.

In accordance with a further feature of the invention, the water chamber is formed with a closable opening for affording accessibility to the interior thereof.

Other features which are considered as characteristic for the invention are set forth in the appended claims.

Although the invention is illustrated and described herein as feedwater preheater with two steam chambers, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the single figure of the drawing which is a diagrammatic longitudinal sectional view of the feedwater preheater constructed in accordance with the invention.

Referring now to the figure of the drawing, there is shown therein the feedwater preheater of the invention, having a connecting piece 1 through which feedwater enters an inlet chamber 2 of the feedwater preheater. Tubes 4, which are disposed in an outer steam chamber 12, are connected to the inlet chamber 2 through openings in the wall of the latter that are not shown in the figure. The steam chamber 12 is closed to the outside by a jacket 3. The tubes 4 have a 180° bend therein at the end of the steam chamber or heat exchanger 12 that is opposite or remote from the inlet chamber 2, and communicate with a water chamber 5 through non-illustrated openings formed in a wall of the latter. The water chamber 5 partially defines an inner steam chamber 13, which is further defined by the steam jacket 14 and an outlet chamber 7 for the feedwater. In the inner steam chamber 13, rectilinear tubes 6 are located between the water chamber 5 and the outlet chamber 7 and communicate therewith through non-illustrated openings formed in respective walls thereof. Except for the non-illustrated openings through which the water chamber 5 communicates with the tubes 4 and 6, the water chamber 5 is otherwise in itself closed. The amount of the tubes 6 in the inner chamber 13 can differ from the amount of the tubes 4 in the steam chamber 12. Advantageously, the inner cross section of the tubes 4 and 6 are such that the entire cross section of all of the parallel-connected tubes in the respective steam chambers 12 and 13 is substantially equal or, in other words, the total flow cross section of all of the tubes 4 substantially equals that of all of the tubes 6. Turbine bleeder steam which is to be condensed enters through a connecting piece 9 into the outer steam chamber 12 and through a connecting piece 11 into the inner steam chamber 13. Condensate leaves the steam chambers 12 and 13 through respective connecting pieces 10 and 15, and the feedwater leaves the feedwater preheater through a connecting piece 8.

The inner-disposed water chamber 5 can follow the various thermal expansions of the tubes 4 and 6, in this construction according to the invention, and is accessible for inspection and repair through a closable opening 16 and a corresponding non-illustrated opening formed in the jacket 3 and normally closed by a suitable non-illustrated cover.

There is claimed:

1. Feedwater preheater installable horizontally within a turbine exhaust steam housing for heating feedwater by means of condensing bleeder steam from the turbine, comprising inlet and outlet chambers for the feedwater both located at one side of the preheater, an outer steam chamber adjacent said inlet and outlet chambers, an inner steam chamber disposed within said outer steam chamber, means for supplying the bleeder steam at different pressures to the respective steam chambers, a water chamber closed in itself partially defining said inner steam chamber, a plurality of feedwater conducting tubes communicating with said feedwater inlet chamber and disposed in said outer steam chamber, said tubes having a substantially 180° bend formed therein at a location of said outer steam chamber remote from said feedwater inlet chamber and communicating at said bend thereof with said water chamber, and a plurality of additional tubes disposed in said inner steam chamber and communicating at one end thereof with said water chamber and at the other end thereof with said outlet chamber.

2. Feedwater preheater according to claim 1 wherein the number of said plurality of tubes in said outer steam chamber differs from the number in said inner steam chamber yet has an inner cross section substantially equal to that of said plurality of tubes in said inner steam chamber.

3. Feedwater preheater according to claim 1 wherein said water chamber is formed with a closable opening for affording accessibility to the interior thereof.

* * * * *